United States Patent [19]

Mon et al.

[11] Patent Number: 4,716,936

[45] Date of Patent: Jan. 5, 1988

[54] FLUIDIC SYSTEM WITH NOISE FILTER FOR INCREASING OPERATING RANGE

[75] Inventors: George Mon, Potomac; James W. Joyce, Rockville, both of Md.

[73] Assignee: The United States of America as represented by the Secretary of the Army, Washington, D.C.

[21] Appl. No.: 946,479

[22] Filed: Dec. 22, 1986

[51] Int. Cl.[4] ..... F15C 1/06; F15C 1/08

[52] U.S. Cl. ..... 137/833; 137/840; 137/550

[58] Field of Search ..... 137/833, 550, 840

[56] References Cited

U.S. PATENT DOCUMENTS 3,528,445 9/1970 Shinn et al. ..... 137/833
3,680,576 8/1972 Kiwak ..... 137/833

FOREIGN PATENT DOCUMENTS 1237696 6/1971 United Kingdom ..... 137/833

*Primary Examiner*—A. Michael Chambers
*Attorney, Agent, or Firm*—Saul Elbaum; Guy M. Miller; Thomas F. McDonald

[57] ABSTRACT

A fluidic system is provided in which the laminar flow operating range has been increased. The fluidic system uses stacks of laminate plates in which filter means is placed between vent and exhaust laminates for breaking up eddies and flow noise created from supply nozzle and vent areas.

6 Claims, 8 Drawing Figures

FIG. 1
PRIOR ART
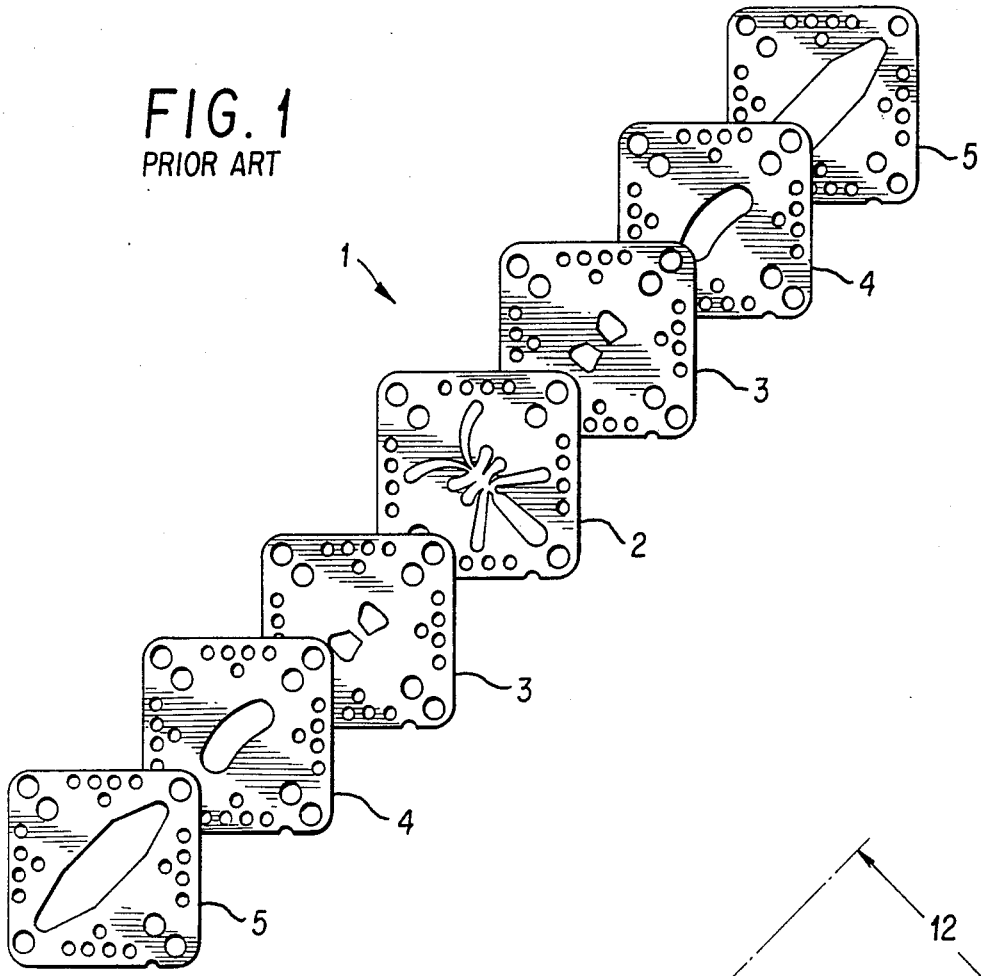
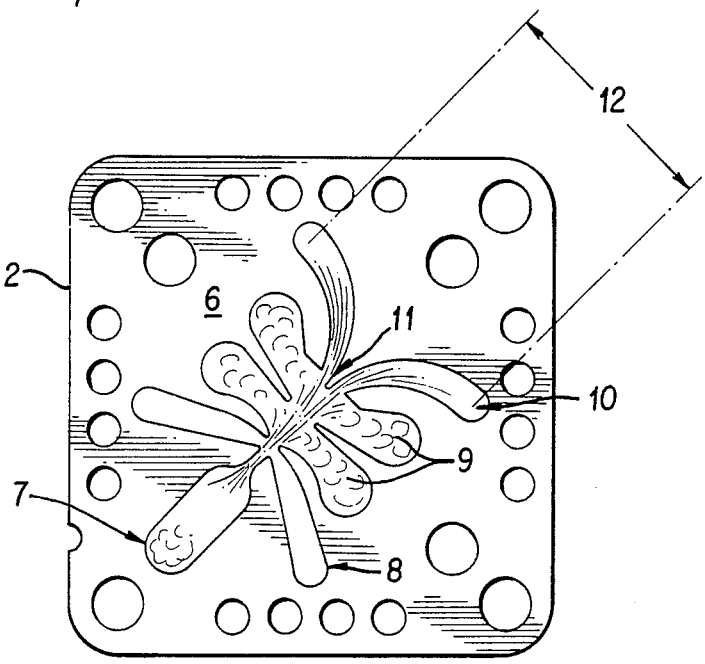
FIG. 2

FLUIDIC SYSTEM WITH NOISE FILTER FOR INCREASING OPERATING RANGE

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

This invention relates generally to fluidic elements and, more particularly, is directed towards fluidic systems having improved operating ranges.

2. Description of the Prior Art

One of the major problems present in laminar fluidic systems is the limited operating range of these systems due to the transition from laminar to turbulent flow. This phenomena exists in systems comprising active fluidic elements known as the laminar proportional amplifier (LPA) and laminar jet angular rate sensor (LJARS). The laminar-to-turbulent transitional Reynolds number, $N_R$, for a standard "C" format LPA is only about 1100 while a fully developed laminar pipe flow has a transitional $N_R$ of about 2300. Therefore there is room for improvement. The useful operating range of a standard LPA is also limited by its low pressure gain below a Reynolds number of about 500 and its variable pressure gain over its operating range.

The problem of premature laminar-to-turbulent transition is caused by flow noises generated by the supply nozzle and venting areas around the splitter in these active devices. At low Reynolds numbers, these flow noises can be dampened by the viscous action of the fluid. However, at high Reynolds numbers, they can trigger the laminar-to-turbulent transition and thus limit the operating range of the laminar flow fluidic devices. If these flow noises could be suppressed or dampened, the operating range can be extended.

OBJECTS AND SUMMARY OF THE INVENTION

It is therefore an object of this invention to extend the operating range of fluidic systems.

Another object of the invention is to devise a technique for suppressing or damping flow noises that are generated in fluidic systems.

A further object of the invention is to produce a more constant pressure gain region within the laminar flow regime of fluid systems.

An additional object of the invention is to extend the operating range of fluidic systems without any modification to their basic configuration.

The foregoing and other objects are obtained in accordance with the present invention through the provision of a filter which comprises a thin laminate plate having a plurality of holes forming a screen. The filter is positioned between a vent laminate and exhaust laminate commonly found in fluidic systems. The placing of a filter in this manner breaks up large eddies coming from the supply nozzle and vent areas, thus reducing flow noises as the flow proceeds through the system. The reduction of flow noises increases the system's operating range.

BRIEF DESCRIPTION OF THE DRAWINGS

FIG. 1 shows an example of a typical laminate stack for a LPA integrated circuit assembly.

FIG. 2 shows a laminate with a LPA element formed therein with flow noises.

DETAILED DESCRIPTION OF THE PREFERRED EMBODIMENTS

Figure 3:
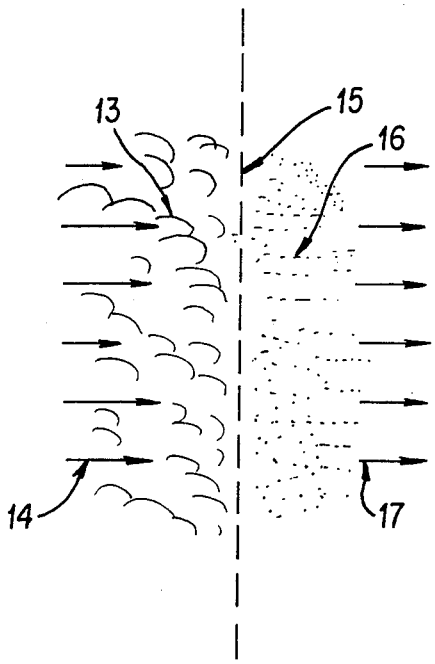
FIG. 3 shows turbulent non-uniform flow being transformed to a more uniform less turbulent flow.

Referring now to the drawings, like reference numerals represent identical or corresponding parts throughout the several views. FIG. 1 illustrates an exploded perspective view of a previously known laminate stack buildup of a LPA integrated circuit fluidic assembly 1. Each laminate within the stack follows a standard "C" format. The standard laminate is planar with two flat sides 3.3 cm×3.3 cm (1.3 in.×1.3 in.) square and has a thickness which depends on the functional purpose and method of fabrication of the laminate. For stamped or photochemically milled laminates, individual laminate thicknesses are usually between 0.1 mm (0.004 in.) and 0.64 mm (0.025 in.). For ease of description all laminates will be refered to by their function according to the particular functional element formed therein.

FIG. 1 is an example of a two sided venting stacking arrangement for a single stage LPA integrated circuit assembly. An LPA laminate 2 is surrounded on both sides by vent laminates 3, vent collector laminates 4 and exhaust laminates 5. In addition to the LPA, vent and exhaust laminates shown, those of ordinary skill in the art will appreciate that gasket laminates are required to block off specific flow passages and transfer laminates are required to transfer a signal from one location to another. Filter screens are also used, located in the laminate stack near the base plate/manifold, for providing last chance filtering of dirt particles in the fluid.

Depending on amplifier design and operating conditions, satisfactory operation may be possible with the LPA laminate vented from only one side; a plain gasket would then be used adjacent the LPA laminate on the opposite side as the vent laminate.

During the operation of the amplifier assembly, fluid is injected into the supply nozzle of the LPA laminate. FIG. 2 shows a typical LPA laminate plate 2 with an LPA element 6 formed therein. The LPA has a supply nozzle 7, control nozzle 8, vents 9, output 10, and splitter 11. A differential output pressure is generated at the outputs 12. Flow noises in the form of large eddies are generated in the LPA element at the supply nozzle 7 and vents 9 creating turbulent flow. Breaking up this non-uniform turbulent flow will extend the operating range of the device. Using a filter screen, like the type used for filtering dirt, may break up this non-uniform turbulent flow.

Figure 4:
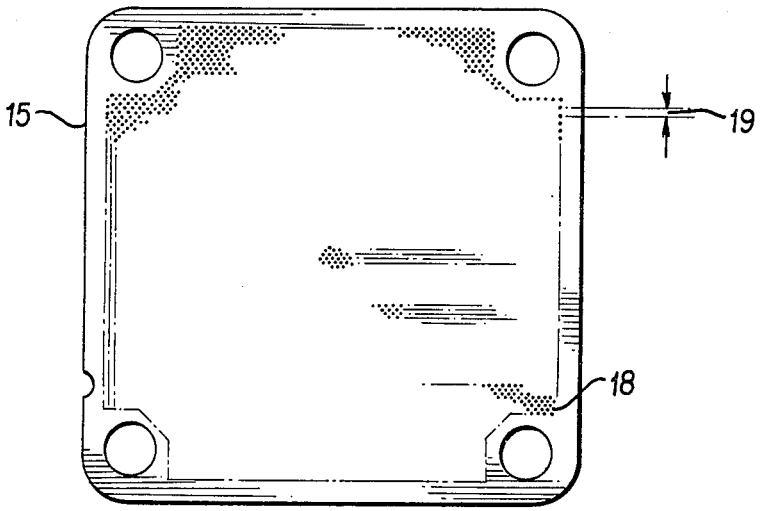
FIG. 4 shows a filter screen that may be used in accordance with this invention.

FIG. 3 shows large eddies 13 creating turbulent flow 14 passing through a filter screen 15 forming small eddies 16 creating a more uniform flow 17. A filter screen 15 is shown in FIG. 4 comprising holes 18 of a diameter of about 0.25 mm and about 0.53 mm apart 19. In general, a screen with smaller openings can filter the flow noise better than a screen with larger openings. However, one also has to consider the area ratio between total openings and the screen. If this area ratio is too small, the flow resistance of the filter screen will waste too much energy because of the excessive pressure drop. Therefore one has to minimize this energy loss without compromising its performance. A filter screen with the dimension discussed herein has only a flow resistance of 0.01 mm Hg/LPM per screen for a 2.25 mm diameter screen. No discernable pressure flow difference is experienced with a screen with this resistance.

Figure 5:
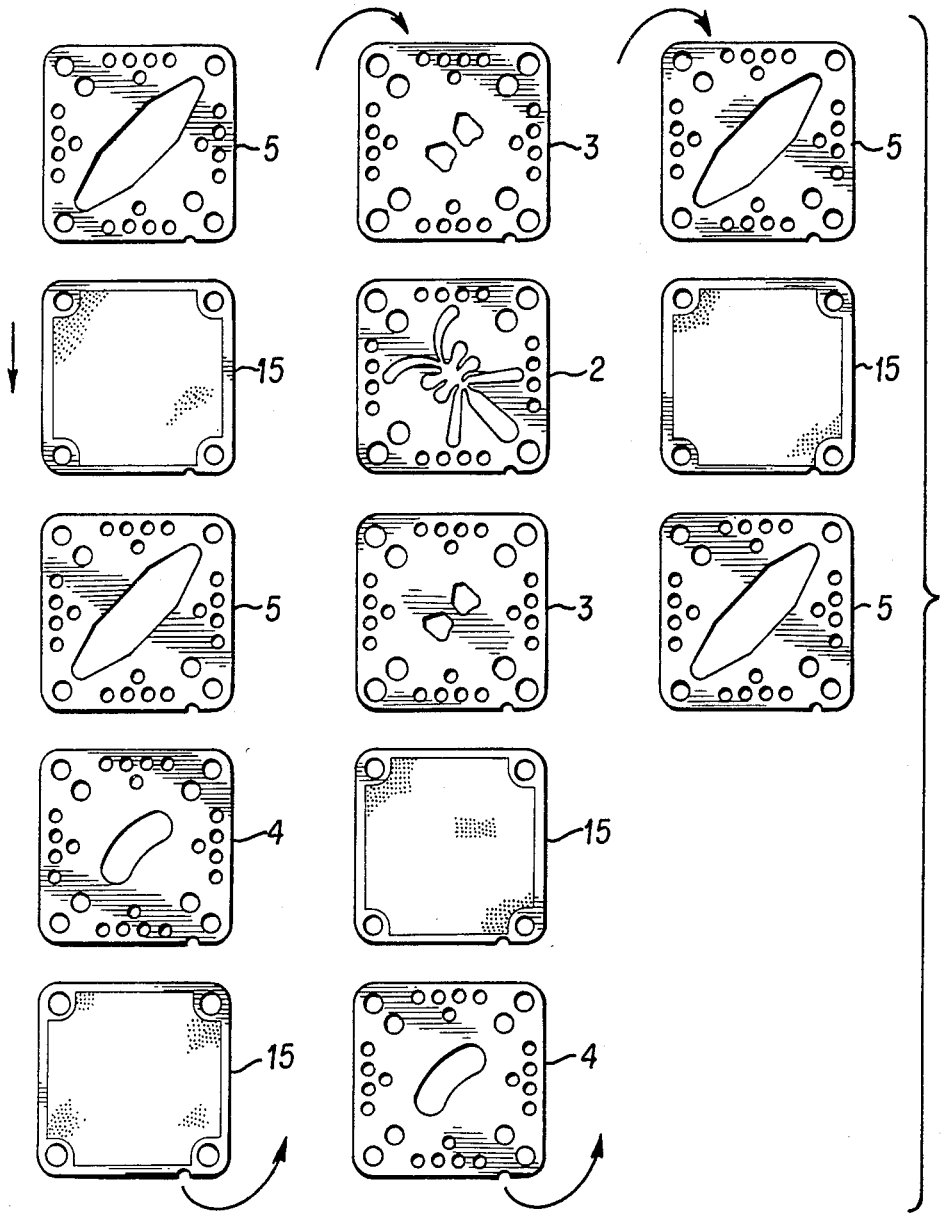
FIG. 5 shows the stacking arrangement of an extended operating range LPA circuit assembly in accordance with this invention.

What is more important than the filter or screen size is the placement of the filter screens within the stack assembly. FIG. 5 shows a stacking arrangement for a two sided venting single stage LPA circuit assembly with the order of stacking as shown. Filter screens 15 are positioned in the stack between vent laminates 3 and vent collector laminates 4. This position of the screen 15 within the stack provides the best noise reduction and increase in laminar flow operating range.

Positioning the screens between the LPA laminate 2 and vent laminate 3 does not result in a workable design. The symmetrical stacking arrangement also has screens placed between exhaust laminates 5 as shown. These screens help further reduce flow noise within the system. The placing of filter screens throughout a fluidic system in this fashion will help reduce flow noise and thus increase the laminar operating range of the system. It is understood that the placement of screens is identical for one sided venting systems.

Figure 6:
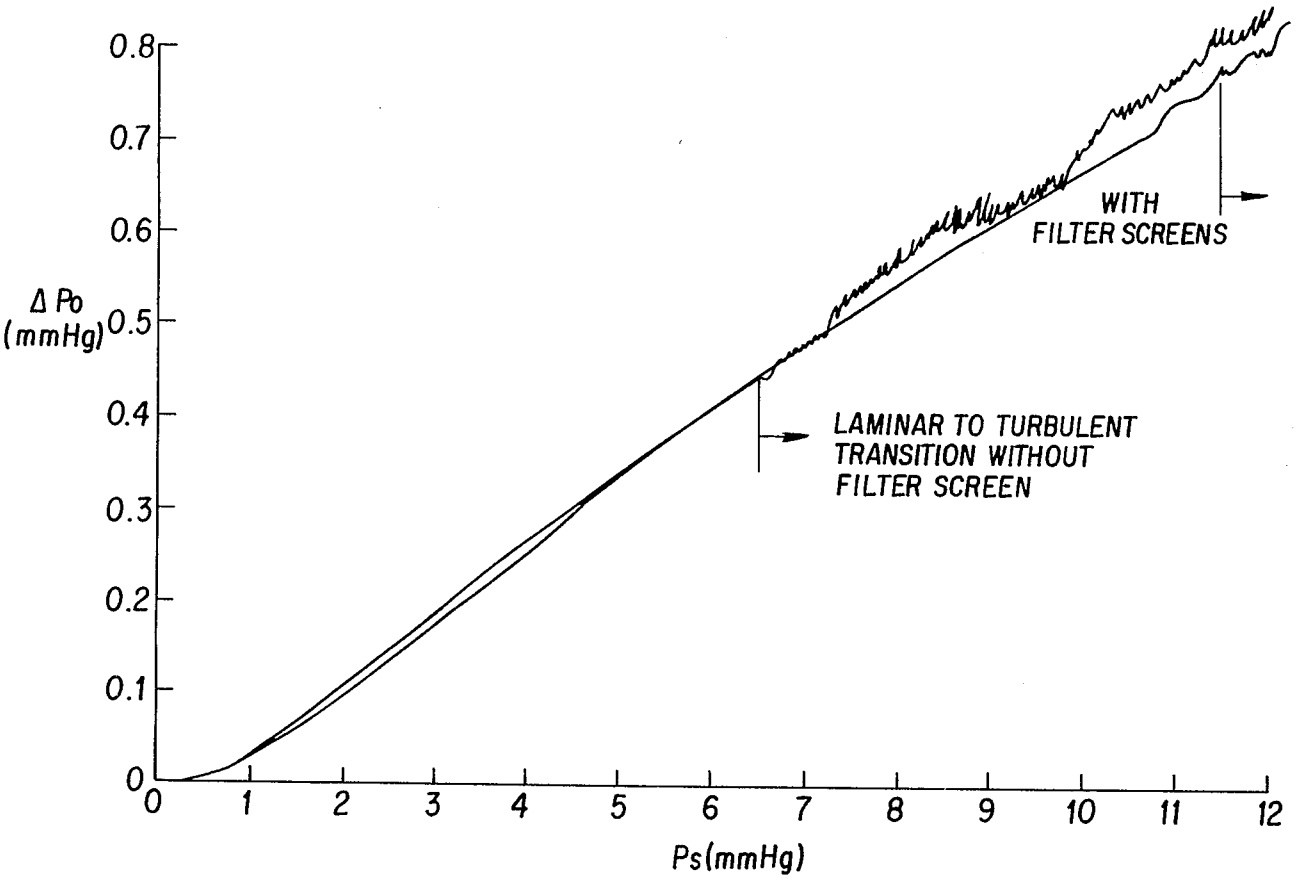
FIG. 6 shows a graph of the differential output pressure versus supply pressure in a LPA circuit assembly with and without filter screens.

FIG. 6 shows a typical plot of the differential output pressure, $P_0$, versus the supply pressure, Ps, of a single stage two sided vented LPA circuit assembly with and without filter screens placed as shown in FIG. 5. FIG. 6 shows that the transition from laminar to turbulent flow using the screens has been significantly delayed. It also shows that the noise levels in the turbulent flow region in the new design are much lower than those without the screen.

Figure 7:
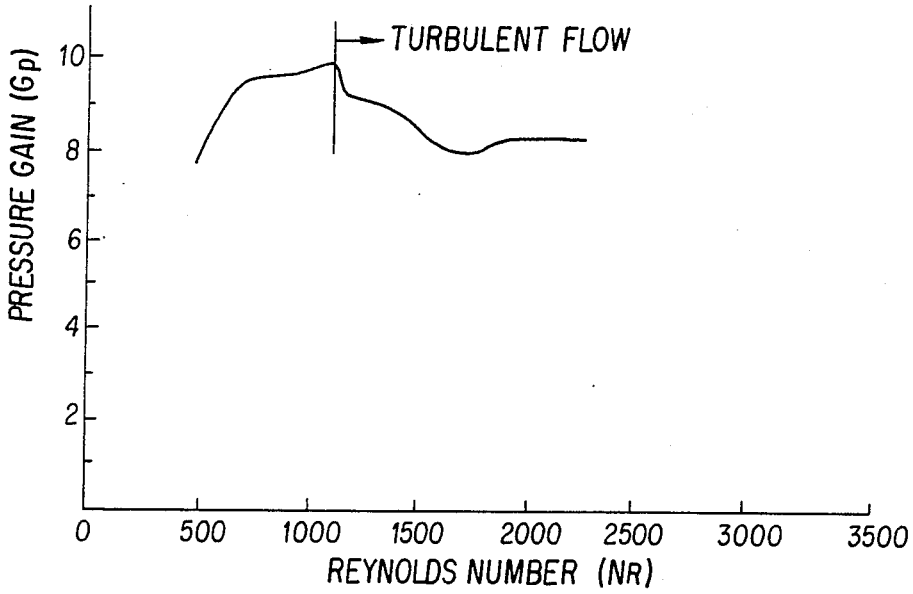
FIG. 7 PRIOR ART
FIG. 7 shows a graph of the blocked load pressure gain versus Reynolds number for a typical LPA circuit assembly.
Figure 8:
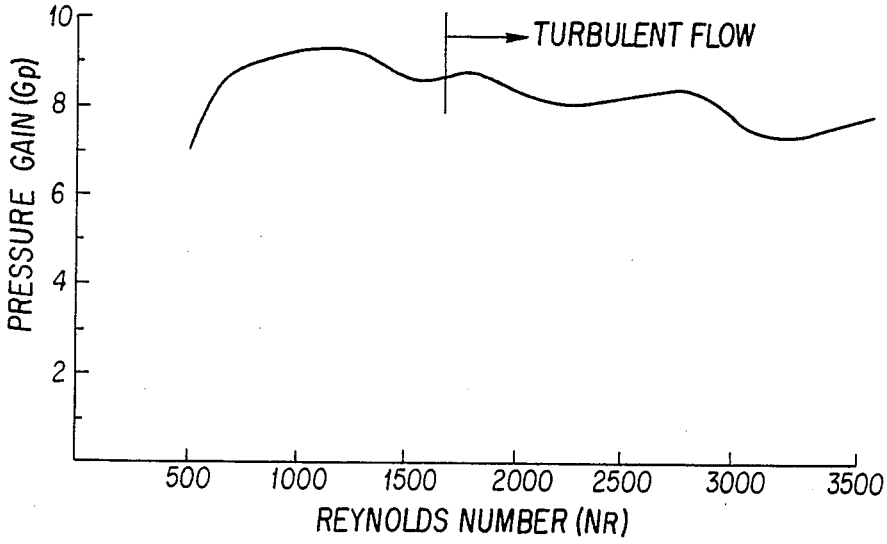
FIG. 8 shows a graph of the blocked load pressure gain versus Reynolds number for an extended range LPA circuit assembly in accordance with this invention.

FIGS. 7 and 8 show plots of the block load pressure gain of the old and new design LPA circuit assemblies respectively as a function of the Reynolds number ($N_R$). As shown in the old design, FIG. 7, the transitional Reynolds number is about 1100 while in the new design, FIG. 8, the transitional Reynolds number has been extended from about 1100 to about 1700. It is also evident that within the laminar regime the pressure gain is relatively constant from $N_R=700$ to 1700 for the new design and from $N_R=700$ to 1100 for the old design. This represents a two and a half times improvement on the operating Reynolds number range in which the pressure gain is relatively constant.

The use of filter screen laminates with the approximate mesh size described herein, together with active elements such as LPA and LJARS laminates in stacking orders of the type detailed above defines a technique that will extend the useful operating range of these active elements by significantly delaying their transition to turbulent flow.

We wish it to be understood that we do not desire to be limited to the exact details of construction shown and described as it is obvious the concept applies to any other laminate configurations that are used to construct fluidic circuits containing laminar flow active elements.

We claim:

1. A fluidic system comprising:

a first laminate having an active element formed therein;

a second laminate superimposed on a first side of said first laminate having a vent element formed therein for extracting vent flow from said active element;

a third laminate superimposed adjacent said second laminate having an exhaust element formed therein for transferring vent flow away from said second laminate (plate);

filter means positioned between the vent element of said second laminate and the exhaust element of said third laminate for breaking up eddies passing between said second third laminates, whereby the range of laminar flow of said fluidic systems is extended.

2. A fluidic system as claimed in claim 1 wherein said filter means comprises:

a fourth laminate having a plurality of holes forming a screen.

3. A fluidic system as claimed in claim 2 wherein said holes are about 0.25 mm in diameter and about 0.53 mm apart from center to center.

4. A fluidic system as claimed in claim 1 wherein said active element is a laminar proportional amplifier.

5. A fluidic system as claimed in claim 1 wherein said active element is a laminar jet angular rate sensor.

6. A fluidic system as recited in claim 1 further comprising:

a fifth laminate superimposed on a second side of said first laminate having a second vent element formed therein for extracting vent flow from said active element;

a sixth laminate superimposed adjacent said fifth laminate having a second exhaust element formed therein for transferring vent flow away from said fifth laminate (plate);

second filter means positioned between the second vent element of said fifth laminate and the second exhaust element of said sixth laminate for breaking up eddies passing between said fifth and sixth laminates, whereby a symmetrical filter arrangement is provided for extending the range of laminar flow of said fluidic system.

* * * * *